US005648622A

United States Patent [19]

Storey

[11] Patent Number: 5,648,622

[45] Date of Patent: Jul. 15, 1997

[54] PICK FOR A STRINGED MUSICAL INSTRUMENT

[76] Inventor: David C. Storey, 527 Roy North Rd., Carrollton, Ga. 30117

[21] Appl. No.: 588,509

[22] Filed: Jan. 18, 1996

[51] Int. Cl.[6] ..... G10D 3/16

[52] U.S. Cl. ..... 84/322; D17/20

[58] Field of Search ..... 84/322, 320; D17/20

[56] References Cited

U.S. PATENT DOCUMENTS

| | | | |
|---|---|---|---|
| 998,440 | 7/1911 | Willat | 84/322 |
| 1,009,403 | 11/1911 | Gaynor | 84/322 |
| 1,254,577 | 1/1918 | Carpenter et al. | 84/322 |
| 1,461,070 | 7/1923 | Rudesyle | 84/322 |
| 2,459,274 | 1/1949 | Galetzky | 84/322 |
| 3,112,668 | 12/1963 | Moshay | 84/322 |
| 3,739,681 | 6/1973 | Dunlop | 84/322 |
| 4,228,719 | 10/1980 | Keene | 84/322 |
| 4,691,609 | 9/1987 | Acocella | 84/322 |
| 5,271,308 | 12/1993 | Balog | 84/322 |
| 5,307,723 | 5/1994 | De La Rosa | 84/322 |
| 5,419,228 | 5/1995 | Garrett et al. | 84/322 |

*Primary Examiner*—Cassandra C. Spyrou
*Attorney, Agent, or Firm*—Laubscher & Laubscher

[57] ABSTRACT

A pick of plectrum for a stringed musical instrument is characterized by an intermediate portion having a greater degree of flexibility than the top and bottom portions of a generally triangularly shaped body. The portions of the pick are gripped by the player between the thumb and index finger and the bottom portion is used to pluck the strings of the instrument. The player can alter the amount of flexibility of the pick by moving the thumb and index finger to grip a selected portion of the intermediate portion.

5 Claims, 1 Drawing Sheet

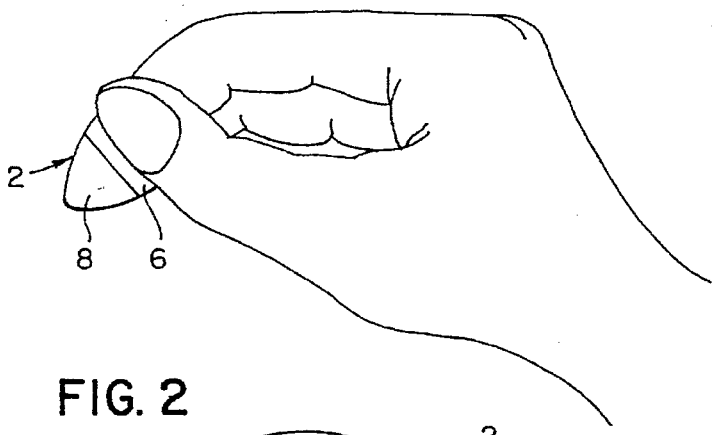
FIG. 1
FIG. 2
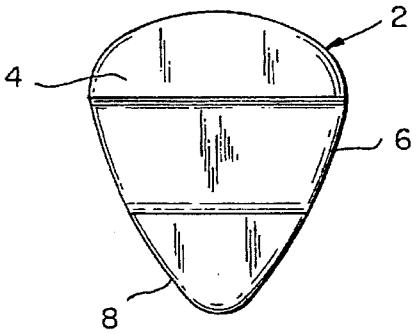
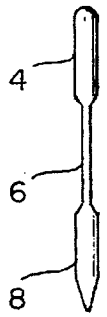
FIG.3
FIG. 4
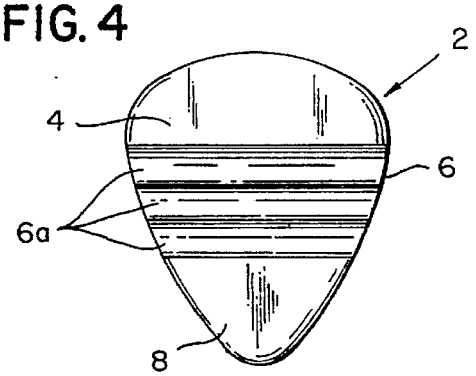
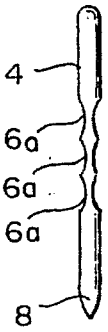
FIG.5
FIG. 6
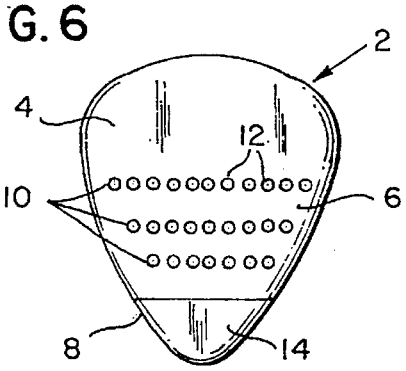
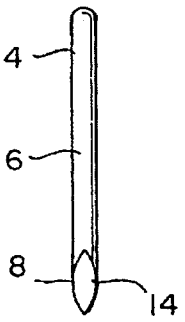
FIG. 7

PICK FOR A STRINGED MUSICAL INSTRUMENT

BACKGROUND OF THE INVENTION

The present invention relates to picks or plectrums which are used in the playing of stringed musical instruments such as guitars and mandolins of the lute family. The pick is generally held between the thumb and index finger of one hand and is used to pluck the strings of the instrument. The tone produced by a stringed musical instrument will vary considerably depending on the stiffness of the pick. A relatively stiff pick will give the effect of more attack to the plucked string than a very thin pick which will more likely produce a softer tone regardless of how hard the string is plucked. Because of its flexibility, a thin pick tends to brush over the strings.

It is desirable when playing a tune to be able to shift between the relatively hard and soft tones available from different picks. The pick according to the present invention is capable of producing both hard and soft tones.

BRIEF DESCRIPTION OF THE PRIOR ART

Various attempts have been made in the past to provide picks which allow the player some degree of different picking abilities without having to change between a stiff pick and a soft pick in midstream. For example, the Keene U.S. Pat. No. 4,228,719 discloses a pick with different flexibilities in each playing corner owing to the provision of different sized holes in the corners. However, in order to take advantage of the different flexibilities, it is necessary to rotate the pick in the player's fingers which is virtually impossible between individual notes, especially during speed picking.

The Galetzky U.S. Pat. No. 2,459,274 disclosed a mandolin pick including a rather complicated slide and screw adjustment mechanism for altering the pick's properties. The adjustment mechanism is not suitable for use during a performance and particularly between the playing of individual notes.

Finally, the Gaynor U.S. Pat. No. 1,009,403 discloses a picking device having a cup mechanism which when squeezed by the player alters the flexibility of the pick but only between soft and stiff with no intermediate range nor the ability to vary the flexibility gradually.

The present invention was developed in order to overcome these and other drawbacks of the prior devices by providing a single plectrum that is instantly variable over the entire spectrum included within a stiff or thick pick that enables a player to strike an instrument's strings with a stronger attack and a very thin pick which allows the player to brush over a string or strings in order to produce a softer tone and every variation therebetween.

SUMMARY OF THE INVENTION

Accordingly, it is a primary object of the present invention to provide a musical instrument pick having a generally triangular shaped body with a broad top portion, an intermediate portion, and a narrow bottom portion. The intermediate portion has a greater degree of flexure than the top and bottom portions. When the pick is held between the thumb and index finger of a player of the instrument and the bottom portion is used to pluck the instrument strings, the player can alter the amount of flexibility of the pick by moving the thumb and index finger relative to the pick's intermediate portion.

According to a preferred embodiment, the increased flexibility of the pick intermediate portion results from forming the intermediate portion with a thickness less than that of the top and bottom portions.

In an alternate embodiment, the thinner intermediate portion may also include a plurality of laterally spaced segments allowing for a variety of different flexibilities at each segment.

In another alternate embodiment, the pick intermediate portion contains a plurality of spaced apertures to increase the flexibility thereof.

It is yet another object of the invention to form the pick and the tip of the bottom portion thereof from different materials. Preferably, the pick is formed of synthetic plastic and the tip is formed of metal.

BRIEF DESCRIPTION OF THE FIGURES

Other objects and advantages of the invention will become apparent from a study of the following specification when viewed in the light of the accompanying drawing, in which:

FIG. 1 is an illustration of the pick of the invention as held in the player's hand;

FIGS. 2 and 3 are front and side plan views, respectively, of a preferred embodiment of the pick according to the invention;

FIGS. 4 and 5 are front and side plan views, respectively, of a second embodiment of the pick;

FIGS. 6 and 7 are front and side plan views, respectively, of a third embodiment of the invention.

DETAILED DESCRIPTION

There is shown in FIG. 1 a pick or plectrum 2 according to the invention and gripped between the thumb and index finger of the hand of the player of a stringed musical instrument such as a guitar, mandolin, or lute. As shown in FIGS. 2,4, and 6, the pick has a generally triangular configuration including a broader top portion 4, an intermediate portion 6, and a narrow bottom portion 8.

The intermediate portion 6 of the pick is designed to have a greater degree of flexibility than the top and bottom portions. During play of an instrument's strings, the musician can vary the grip of the pick. When a louder tone is needed in any given passage, the thumb and index finger are positioned in order to encompass the whole of intermediate 6 portion of the pick. This acts as a bridge between the top portion 4 and the narrow bottom portion 8, thereby stiffening the pick and allowing for more attack of the plucked string or strings. As the player rolls the thumb and index finger back, he starts to expose the intermediate portion 6. As this is exposed, the pick becomes more and more flexible. When the player grips mainly the top portion 4 of the pick and the full intermediate portion is exposed, the pick becomes very flexible which may be preferred for rhythm playing and speed picking. By moving the thumb and index finger in very small degrees, any desired amount of flexibility is instantly available for any given note of a passage enabling the player to be much more expressive during a performance.

The increased flexibility of the pick can be accomplished with different types of construction. Preferably, the pick is formed as a unitary body member of synthetic plastic material. In the preferred embodiment shown in FIGS. 2 and 3, the intermediate portion 6 is thinner than the top and bottom portions, thereby affording a greater flexibility to the intermediate portion. Between the playing of one note and the next, the player can shift the pressure of the thumb and finger from the bottom portion 8 to the top portion 4, thereby exposing the more flexible intermediate portion 6, or any part thereof. For example, the player while playing can manipulate his grip of the pick to expose either the lower part of the intermediate portion or any amount thereof. This gradually increases the flexibility to the point that the player can reach any desired effect required for the correct striking of an individual note. This better enables the player to articulate a passage of notes and makes individual note playing or strumming more expressive.

In the embodiment shown in FIGS. 4 and 5, the thinner intermediate section 6 is divided into parallel segments 6*a* extending laterally across the body of the pick. The segments 6*a* not only facilitate a better grip but also enable the player to release individual segments of varying thickness allowing for a different degree of flex at each segment.

In the embodiment of FIGS. 6 and 7, the intermediate section 6 is not thinner than the top and bottom sections 4, 8. Rather, the intermediate section contains a plurality of spaced openings 12. These openings afford the increased flexibility in the intermediate section.

While the pick is preferably molded from a single material, it can also include a different material in the tip 14 of the bottom portion. One such material is metal. Although the metal tip is shown only in FIGS. 6 and 7, it can be used in the embodiments of FIGS. 1–5. Moreover, it is not required that the embodiment of FIGS. 6 and 7 include a tip of different material.

While in accordance with the provisions of the patent statute the preferred forms and embodiments of the invention have been illustrated and described, it will be apparent to those of ordinary skill in the art that various changes and modifications may be made without deviating from the inventive concepts set forth above.

What is claimed is:

1. A pick for a stringed musical instrument, comprising a generally triangular shaped body having a broad top portion, an intermediate portion and a narrow bottom portion, said intermediate portion containing a plurality of spaced apertures and having a greater degree of flexure than said top and bottom potions, whereby when said portions are held between the thumb and index finger of a player of the instrument and said bottom portion is used to pluck the strings of the instrument, the player can alter the amount of flexibility for a note by moving the thumb and index finger to grip a selected portion of said pick intermediate portion.

2. A pick as defined in claim 1, wherein said bottom portion includes a lower metal tip.

3. A pick for a stringed musical instrument, comprising a generally triangular shaped unitary body having a broad top portion, an intermediate portion and a narrow bottom portion all formed of a same material, said intermediate portion having a thickness less than that of said top and bottom portions and having a greater degree of flexure than said top and bottom portions, whereby when said body is held between the thumb and index finger of a player of the instrument and said bottom portion is used to pluck the strings of the instrument, the player can alter the amount of flexibility for a note by moving the thumb and index finger to grip a selected portion of said pick intermediate portion.

4. A pick as defined in claim 3, wherein said intermediate portion comprises a plurality of lateral segments having a concave vertical cross-sectional configuration.

5. A pick as defined in claim 3, and further comprising a metal tip at the lower end of said bottom portion.

* * * * *